US008668312B2

(12) United States Patent
Xie et al.

(10) Patent No.: US 8,668,312 B2
(45) **Date of Patent: *Mar. 11, 2014**

(54) LIQUID EJECTION WITH ON-CHIP DEFLECTION AND COLLECTION

(75) Inventors: Yonglin Xie, Pittsford, NY (US); Qing Yang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/456,520

(22) Filed: Apr. 26, 2012

(65) Prior Publication Data

US 2013/0286108 A1 Oct. 31, 2013

(51) Int. Cl.
*B41J 2/09* (2006.01)

(52) U.S. Cl.
USPC ..... 347/77

(58) Field of Classification Search
USPC ..... 347/73–82, 90
See application file for complete search history.

(56) References Cited

U.S. PATENT DOCUMENTS 4,636,808 A 1/1987 Herron
5,237,883 A 8/1993 Churchill et al.
6,079,821 A 6/2000 Chwalek et al.
6,517,197 B2 2/2003 Hawkins et al.
7,364,276 B2 4/2008 Piatt et al.
7,399,068 B2 7/2008 Anagnostopoulos et al.
7,850,283 B2 12/2010 Piatt et al.
2006/0197810 A1 9/2006 Anagnostopoulos et al.
2008/0122900 A1 5/2008 Piatt et al.
2008/0284835 A1 11/2008 Panchawagh et al.
2009/0033727 A1 2/2009 Anagnostopoulos et al.
2010/0328403 A1 12/2010 Xie et al.
2010/0328407 A1 12/2010 Xie et al.

*Primary Examiner* — Kristal Feggins
(74) *Attorney, Agent, or Firm* — William R. Zimmerli

(57) ABSTRACT

A printhead includes a substrate and monolithic liquid jetting structure including a nozzle, deflection mechanism, and catcher. The nozzle, through which a liquid jet is ejected in a direction substantially parallel to a first surface of the substrate, includes material layers formed on the first surface of the substrate. At least one of the material layers of the nozzle includes a drop forming mechanism actuated to form liquid drops from the liquid jet. The deflection mechanism is associated with the liquid jet and deflects portions of the liquid jet between first and second paths. Liquid drops formed from portions of the liquid jet following the first path and the second path continue to follow the first path and the second path, respectively. The catcher, including a material layer formed on the first surface of the substrate, collects liquid drops following one of the paths.

15 Claims, 10 Drawing Sheets

LIQUID EJECTION WITH ON-CHIP DEFLECTION AND COLLECTION

CROSS REFERENCE TO RELATED APPLICATIONS

Reference is made to commonly-assigned, U.S. patent application Ser. No. 13/456,537, entitled "LIQUID EJECTION WITH ON-CHIP DEFLECTION AND COLLECTION", filed concurrently herewith.

FIELD OF THE INVENTION

This invention relates generally to the field of digitally controlled liquid ejection systems, and in particular to continuous liquid ejection systems in which a liquid jet breaks into drops that travel along different trajectories or paths.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Drop placement accuracy of print drops is critical in order to maintain image quality. Liquid drop build up on a drop contact face of a catcher, for example, can adversely affect drop placement accuracy. When this occurs, print drops can collide with liquid that accumulates on the drop contact face of the catcher. Additionally, a catcher, for example, a "knife-edge" catcher, that uses an edge to collect non-print drops typically needs that edge to be straight to within a few microns from one end to the other. A catcher lacking the appropriate amount of edge straightness is susceptible to liquid drop build which can lead to reduced image quality.

During assembly, the catcher has to be carefully aligned relative to a nozzle array of a continuous printhead since the angular separation between print drops and non-print drops is, typically, only a few degrees. Conventional alignment processes are typically laborious procedures and increase the cost of the printhead. When the printhead includes multiple nozzle arrays, each catcher typically needs to be aligned to its corresponding nozzle plate individually and one at a time adding cost and time to the printhead fabrication process.

Since a catcher is typically attached to a printhead frame using screws or adhesive, alignment of the catcher relative to the nozzle array can be compromised when the assembled printhead is subjected to shock, for example, during shipment or during the adhesive curing process. Additionally, a catcher is typically made from materials that are different from materials used to make the nozzle plate and therefore have different thermal coefficients of expansion. As such, alignment issues often arise when the ambient temperature changes. The problems associated with alignment and assembly are exacerbated as the length of the printhead is increased from an inch or less to page wide which could be tens of inches long.

Accordingly, there is an ongoing need to provide an improved liquid catcher for use in printheads and printing systems.

SUMMARY OF THE INVENTION

According to an aspect of the present invention, a printhead includes a substrate and a monolithic liquid jetting structure. The substrate includes a first surface. The monolithic liquid jetting structure includes a nozzle, a deflection mechanism, and a catcher. The nozzle, through which a liquid jet is ejected in a direction substantially parallel to the first surface of the substrate, includes a plurality of material layers formed on the first surface of the substrate. At least one of the plurality of material layers of the nozzle includes a drop forming mechanism actuated to form liquid drops from the liquid jet. The deflection mechanism is associated with the liquid jet and deflects portions of the liquid jet between a first path and a second path after the portion of the liquid jet exits the nozzle. The liquid drops formed from those portions of the liquid jet following the first path continue to follow the first path and the liquid drops formed from those portions of the liquid jet following the second path continue to follow the second path. The catcher, which includes a material layer formed on the first surface of the substrate, collects liquid drops following one of the first path and the second path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
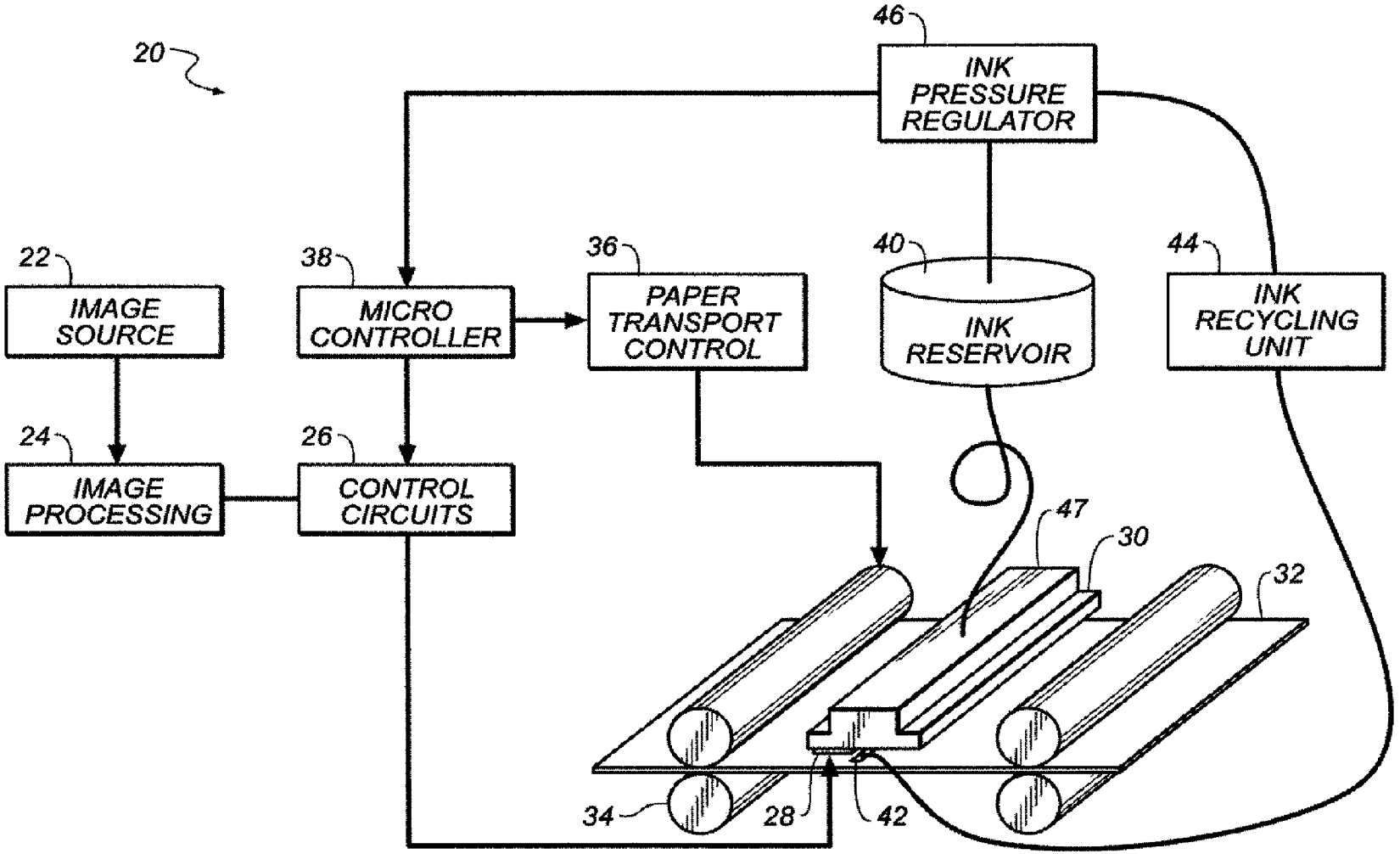
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid," "ink," "print," and "printing" refer to any material that can be ejected by the liquid ejector, the liquid ejection system, or the liquid ejection system components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 reads data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (shown in FIGS. 2-10).

Referring to FIGS. 2 through 9, example embodiments of a printhead made in accordance with the present invention are shown. Generally described, a printhead made in accordance with the present invention includes a substrate and a monolithic liquid jetting structure. The substrate includes a first surface. The monolithic liquid jetting structure includes a nozzle, a deflection mechanism, and a catcher. The nozzle, through which a liquid jet is ejected in a direction substantially parallel to the first surface of the substrate, includes a plurality of material layers formed on the first surface of the substrate. At least one of the plurality of material layers of the nozzle includes a drop forming mechanism actuated to form liquid drops from the liquid jet. The deflection mechanism is associated with the liquid jet and deflects portions of the liquid jet between a first path and a second path after the portion of the liquid jet exits the nozzle. The liquid drops formed from those portions of the liquid jet following the first path continue to follow the first path and the liquid drops formed from those portions of the liquid jet following the second path continue to follow the second path. The catcher, which includes a material layer formed on the first surface of the substrate, collects liquid drops following one of the first path and the second path.

Typically, the printhead includes a plurality of nozzle, for example, arranged in an array, on a common substrate. Liquid, for example, ink, is emitted under pressure through the plurality of nozzles to form filaments of liquid, commonly referred to as liquid jets. In FIGS. 2-9, the plurality of nozzles extends into and out of the figures. The printhead is typically formed from a semiconductor material (for example, silicon) using known semiconductor fabrication techniques (for example, CMOS circuit fabrication techniques, micro-electro mechanical structure (MEMS) fabrication techniques, or a combination of both). For example, the plurality of nozzles is integrally formed through a series of material layering and processing steps, on a common substrate using the fabrication techniques described above to create a monolithic printhead structure. When compared to other types of printheads, monolithic printhead configurations help to improve the alignment of printhead components relative to each other which improves drop deposition accuracy. Monolithic printhead configurations also help to reduce spacing in between adjacent nozzles which helps increase the dots per inch (dpi) capability of the device.

Figure 2:
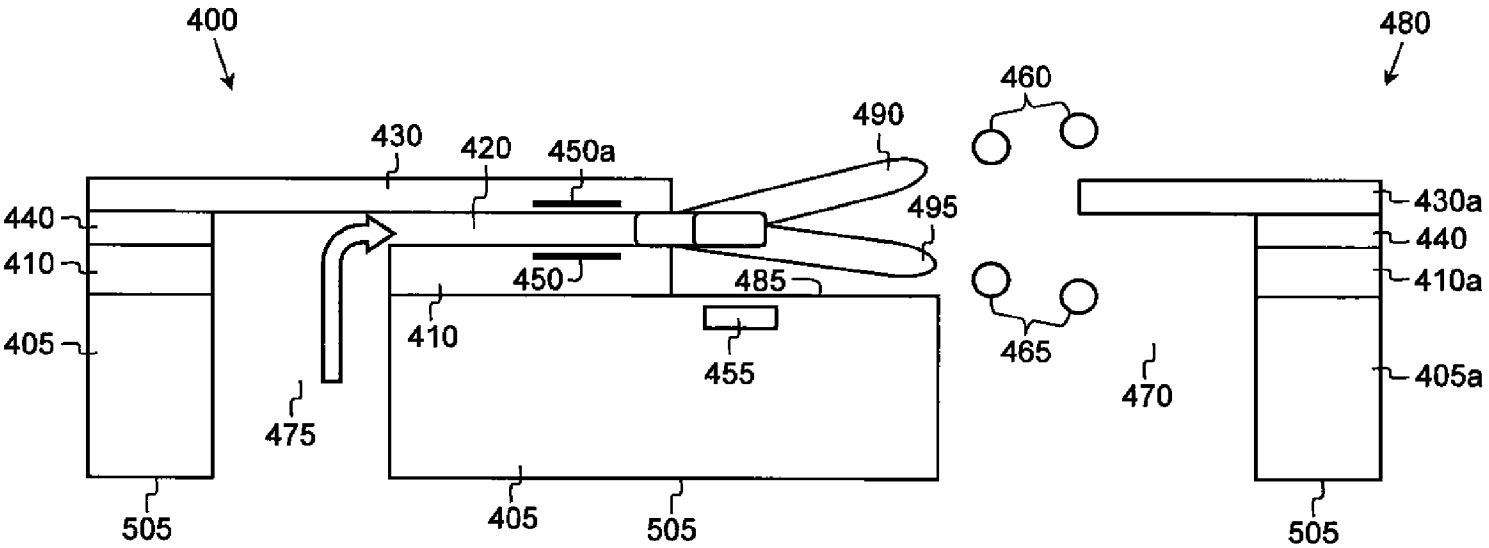
FIG. 2 is a schematic cross sectional view of an example embodiment of a printhead made in accordance with the present invention.

Referring to FIG. 2, a cross-sectional view of printhead 30 including an example embodiment of the present invention is shown. One skilled in the art will recognize this as a cross sectional view of a nozzle and catcher configuration formed using MEMS manufacturing methods well known in the art. In this embodiment, the monolithic liquid jetting structure 400 is formed on a silicon substrate 405. A TEOS (Tetraethyl orthosilicate) layer 410 is deposited on silicon substrate 405. Nozzle 420 is formed by TEOS layer 410 and TEOS layer 430. The spacing between layers 410 and 430 that provides at least the height dimension of nozzle 420 is provided by a polyimide layer 440. In practice, nozzle 420 can be formed using many methods known in the art, including, for example, using a sacrificial layer (not shown), coating TEOS layer 430 over this sacrificial layer, and then removing the sacrificial layer. In FIG. 2, actuator 450 is shown residing in TEOS layer 410 and actuator 450*a* is shown residing in TEOS layer 430. Actuators 450 and 450*a* can be thermal (heater), piezoelectric, electrostatic, bimorph metal micro actuator, or other MEMS actuators formed in layers 410 and 430 using conventional MEMS fabrication techniques. Ink or other liquids are supplied to nozzle 420 through a liquid supply channel 475.

In the cross sectional view provided by FIG. 2, the extension of these previously described layers is also shown. In this view, silicon substrate 405 is separated from silicon substrate 405*a* by a liquid return channel 470. Channel 470 is created, for example, by drilling or etching silicon substrate 405. Silicon substrate 405 and 405*a* are portions of the same piece of silicon, but are shown separately since they are not connected in this cross sectional view. TEOS layer 410 and 410*a* are similarly connected, as are TEOS layer 430 and 430*a*, and polyimide layer 440 and 440*a*.

Liquid return channel 470 is located between the first surface 485 of substrate 405, the surface on which monolithic liquid jetting structure 400 is positioned, and a second surface 505 of substrate 405. Liquid return channel 470 is in fluid communication with a catcher 480 and is provided to remove drops 465 that are not used for printing and facilitate liquid transfer to recycling unit 44. Drops 465 are caught by catcher 480 and can be encouraged to retreat from catcher 480 and flow into liquid return channel 470 using a vacuum or other liquid suction means.

A liquid supply channel 475 is located between the first surface 485 of substrate 405, the surface on which monolithic liquid jetting structure 400 is positioned, and a second surface 505 of substrate 405. Liquid supply channel 475 is in fluid communication with nozzle 420 and is provided to supply liquid, for example, ink, to nozzle 420 from liquid channel 47. In one example embodiment, both the ink return channel 470 and the ink supply channel 475 are formed by an anisotropic deep silicon etching process (DRIE) from the surface (a second surface 505) of the substrate 405 opposite to the surface (the first surface 485) of the substrate 405 where the nozzle and catcher is located.

Catcher 480 is formed in this example embodiment by layers 405*a*, 410*a*, 440*a*, and 430*a*. Catcher 480 includes a drop contact surface, one or more of the surfaces of material layers 405*a*, 410*a*, or 440*a* that is common to liquid return channel 470. This drop contact surface of the catcher and nozzle 420 of monolithic liquid jetting structure 400 are offset relative to each other. Commonly referred to as a "knife edge" catcher, material layer 430*a* of catcher 480 extends toward nozzle 420 to insure that drops 465 that are not intended to be printed are caught and removed. The extension of TEOS layer 430*a* is created by forming the extension on a sacrificial layer (not shown) that is removed after layer 430 is applied. Catcher 480 is precisely positioned with respect to nozzle 420. This precision is accomplished by the nature of the MEMS fabrication process, and can be expected to vary less than a micron. Accordingly, the printhead 30 of the present invention is advantaged when compared to conventional continuous printheads in that the catcher 480 of the monolithic liquid jetting structure of the present invention is accurately aligned relative to the nozzle 420 of the monolithic liquid jetting structure of the present invention. The precise alignment of catcher 480 and nozzle 420 of the monolithic liquid jetting structure of printhead 30 helps maintain print quality by helping to ensure that sufficient separation between print drops and non-print drops is created during the liquid jet deflection and subsequent drop formation process. Accordingly, the present invention takes advantage of the amount of deflection (the deflection angle) created by the deflection mechanism of the printhead.

Accurate alignment of the catcher 480 and the nozzle 420 is also enhanced by the following features of the present invention. A portion of the catcher 480 and a portion of the nozzle 420 of the monolithic structure share a common material layer, for example, one or more of material layers 410, 430, or 440. The common material layer can be located on a side of the liquid jet that is opposite the first surface 485 of substrate 405, for example, material layer 430.

The invention provides accuracy of placement of catcher 480 relative to nozzle 420, so that deflection of drops need not accommodate variation in the placement of the catcher, and the integrated construction of both nozzle 420 and catcher 480 removes the need for a difficult, expensive and time consuming step of alignment. Additionally, by the nature of the fabrication process, catcher 480 is very thin. This provides the additional advantage of making the necessary angle of deflection very small between printing drops and non-printing drops.

Catcher 480 does not need to be aligned as shown in FIG. 2. For example, when the deflection of the liquid jet is not symmetrical, the preferred position for catcher 480 can be different than shown in FIG. 2. The adjustment in position of catcher 480 relative to nozzle 420 can be achieved during the fabrication process, for example, by adding or subtracting thickness to the catcher material layers supporting catcher material layer 430*a*.

During operation of printhead 30, liquid, for example, ink, is continuously emitted under pressure through nozzle 420 to form a filament of liquid 52, commonly referred to as a liquid jet. Drop forming mechanism 28, commonly referred to as a drop forming device, is operable to form liquid drops having a size or volume from the liquid jet 52 ejected through each nozzle 420. To accomplish this, drop forming mechanism 28 includes a drop stimulation actuator(s) 450, 450*a*, for example, a heater or a piezoelectric actuator, that, when selectively activated, perturbs each liquid jet or filament of liquid 52 to induce portions of each jet (or filament) to breakoff from the jet (or filament) and coalesce to form drops 460 and 465.

In FIG. 2, drop stimulation actuator(s) 450, 450*a* includes a heater positioned relative to nozzle 420, for example, located on one or both sides of nozzle 420 or included on or in material layer(s) 410, 430. In alternative example embodiments of the present invention, drop stimulation actuator(s) 450, 450*a* can include a piezoelectric actuator or an electrohydrodynamic stimulator positioned relative to nozzle 420, for example, located on one or both sides of nozzle 420 or included on or in material layer(s) 410, 430. Drop formation using any of these actuators is well known in the art. Typically, one drop forming device 28 is associated with one nozzle 420 of the plurality of nozzles. However, one drop forming device 28 can be associated with groups of nozzles 420 or all of the nozzles 420 of the plurality of nozzles 420.

When drop stimulation actuator 450, 450*a* include heaters deflection of the liquid jet 52 is also accomplished when heat from the heaters is applied asymmetrically to the liquid jet 52 (or filament of liquid). For example, the heater can be a segmented heater with the segments being independently actuatable relative to each other with one segment, 450, being positioned in material layer 410 while another segment, 450*a*, is positioned in material layer 430. When used in this configuration, the heaters, common referred to as asymmetric heaters, operate as the drop forming mechanism and the deflection mechanism. This type of drop formation and drop deflection is known having been described in, for example, U.S. Pat. No. 6,079,821, issued to Chwalek et al., on Jun. 27, 2000. Accordingly, in some example embodiments of the invention, the drop forming mechanism and the deflection mechanism are the same mechanism, for example, a heater.

Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1). As shown in FIG. 2, liquid jet trajectory 490 is the result of action of at least actuator 450*a* and trajectory 495 is the result of action of at least actuator 450. When a heater is activated on one side of the nozzle 420, it causes the fluid to be directed toward the side being heated. When both actuators 450 and 450*a* are actuated, one of actuators 450, 450*a* applies more heat to the liquid jet 52 depending on which liquid jet trajectory 495, 490, respectively, is desired. Because the accuracy of placement of catcher 480 relative to nozzle 420 is precise, the angle of deflection between non-printing trajectory 495 and printing trajectory 490 can be small because the deflection of drops 460, 465 need not accommodate large variations in placement of catcher 480 relative to nozzle 420.

In this configuration of the invention, the deflection mechanism is included (along with the drop forming mechanism) in at least one of the plurality of material layers, for example, one or both of materials layers 410, 430 that form nozzle 420. As such, the deflection mechanism and the drop forming mechanism are located upstream from an exit of nozzle 420 (beyond which a portion of the jet is exposed to atmosphere) relative to the direction of jet ejection.

In one example embodiment of this configuration, actuators 450, 450*a* are thermal actuators. As such, as shown in FIG. 2, the deflection mechanism and the drop forming mechanism include a length dimension that is greater than a height dimension with the length dimension being parallel to the direction of liquid jet 52 ejection through nozzle 420 which helps to add heat to the liquid jet 52 as the liquid jet 52 passes by the actuators ultimately helping to increase the angle of deflection of the liquid jet 52. As the thermal actuators are positioned parallel to the liquid channel included in nozzle channel 420, the actuators provide a large area for heat transfer to the liquid traveling through the fluid channel formed in nozzle 420. This thermal actuator configuration is advantaged in that it helps provide improved heat transfer or large deflection angles.

When drop stimulation actuator 450, 450*a* is a symmetric heater or a piezoelectric actuator or an electrohydrodynamic stimulator deflection can be accomplished using a conventional electrostatic deflection mechanism. Typically, the electrostatic deflection mechanism incorporates drop charging and drop deflection in a single electrode, as described in U.S. Pat. No. 4,636,808, or includes separate drop charging and drop deflection electrodes as is known in the art. When printhead 30 includes an electrostatic deflection mechanism, the electrode(s) 455 of the electrostatic deflection mechanism is positioned proximate to the liquid jet 52, for example, on the first surface 485 of substrate 405. Typically, the location of electrode(s) 455 of the electrostatic deflection mechanism is outside of nozzle 420 and downstream of nozzle 420 relative to the direction of travel of the liquid jet 52. The electrostatic deflection mechanism including the electrode(s) is formed using conventional MEMS or CMOS fabrication techniques. Additional electrodes (not shown) can also be used in conjunction with electrode 455 to enhance or alter the deflected drop trajectories.

Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1). As shown in FIG. 2, liquid jet trajectory 490 and trajectory 495 is the result of action of the electrostatic deflection mechanism. Because the accuracy of placement of catcher 480 relative to nozzle 420 is precise, the angle of deflection between non-printing trajectory 495 and printing trajectory 490 can be small because the deflection of drops 460, 465 need not accommodate large variations in placement of catcher 480 relative to nozzle 420.

In this configuration of the invention, the drop forming mechanism is included in at least one of the plurality of material layers, for example, one or both of materials layers 410, 430 that form nozzle 420. As such the drop forming mechanism is located upstream from an exit of nozzle 420 (beyond which a portion of the jet is exposed to atmosphere) relative to the direction of jet ejection. The deflection mechanism is located downstream from the nozzle exit (beyond which a portion of the jet is exposed to atmosphere) relative to the direction of jet ejection. Additionally, the drop forming mechanism includes a length dimension that is greater than a height dimension with the length dimension being parallel to the direction of liquid jet 52 ejection through nozzle 420 which helps to add heat to the liquid jet 52 as the liquid jet 52 passes by the actuators ultimately helping to create a consistent drop break-off location relative to the electrode(s) 455 for the liquid jet 52.

Figure 3:
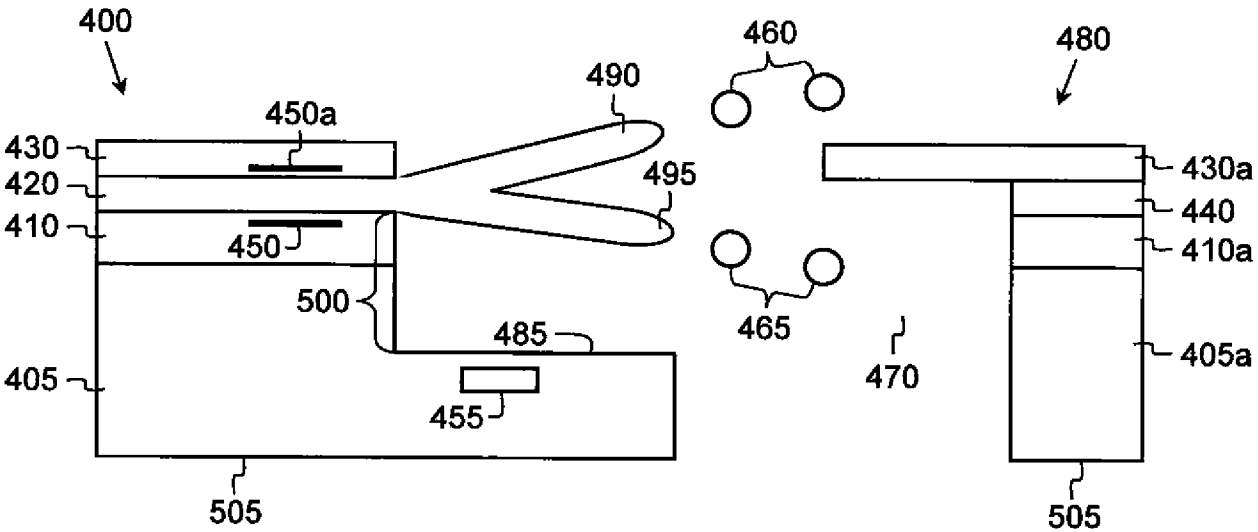
FIG. 3 is a schematic cross sectional view of another example embodiment of a printhead made in accordance with the present invention.

Referring to FIG. 3 is a schematic cross sectional view of another example embodiment of a printhead 30 made in accordance with the present invention is shown. Printhead 30 includes a gap 500, which can also be referred to as a recess, between the exit of nozzle 420 and the silicon substrate 405 under the exit of nozzle 420. Gap 500 is larger to when compared to the gap included in the printhead described above with reference to FIG. 2. Larger gap 500 reduces the possibility of liquid accumulating or sticking to the first surface 485 of silicon substrate 405. Gap 500 can be created using a DRIE (Deep reactive-ion etching) process from the first surface 485 of the silicon substrate, which can be referred to as a wafer, to remove a selected portion of silicon substrate 405. Alternatively stated, the first surface 485 of the substrate 405 is recessed at a location downstream of an exit of nozzle 420 (beyond which a portion of the jet is exposed to atmosphere) relative to the direction of jet ejection.

Figure 4:
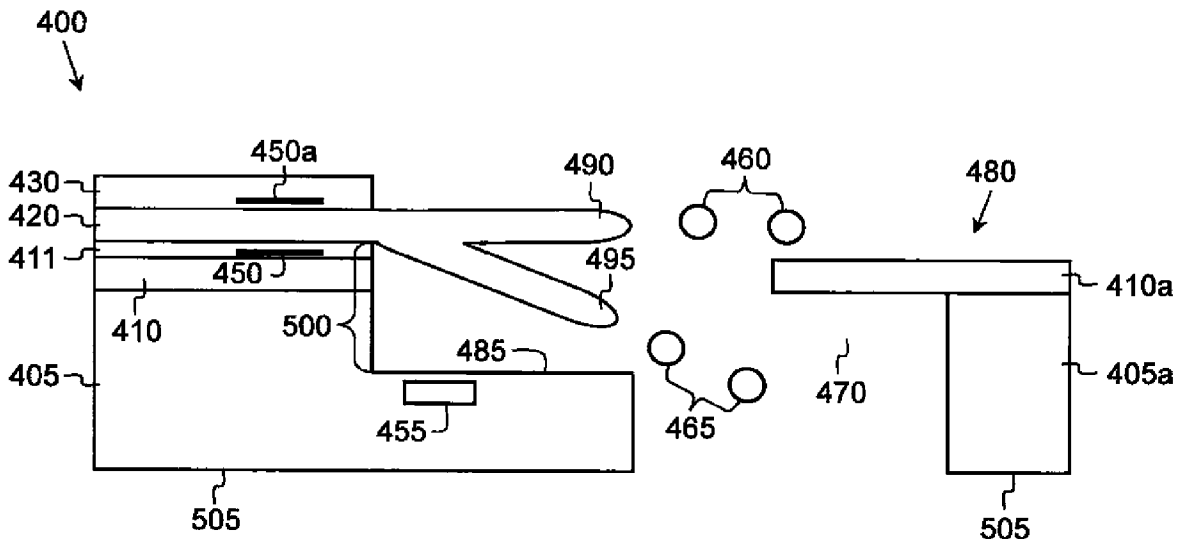
FIG. 4 is a schematic cross sectional view of another example embodiment of a printhead made in accordance with the present invention.

Referring to FIG. 4, a schematic cross sectional view of another example embodiment of a printhead 30 made in accordance with the present invention is shown. In this example embodiment of the invention, an outside surface, for example, material layer 410*a* the top surface of catcher 480 is below an inner surface of nozzle 420. The outside surface of catcher 480 is the top surface of catcher 480 and the inner surface of nozzle 420 is the lower surface or edge of the nozzle exit as shown in FIG. 4. Alternatively stated, an outermost material layer of nozzle 420 is farther away from substrate 405 than an outermost material layer of catcher 480. The outermost material layer of nozzle 420 includes a surface that is exposed to atmosphere. The outermost material layer of catcher 480 includes a surface that is exposed to atmosphere.

Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1). As shown in FIG. 4, liquid jet trajectory 490 is the result of action of both actuators 450, 450*a*, for example, the symmetrical application of heat to the liquid traveling through nozzle 420. Liquid jet trajectory 495 is the result of action of at least actuator 450. Alternatively, both actuators 450, 450*a* can be used in some fashion to create both trajectories 490, 495. When both actuators 450 and 450*a* are actuated, actuator 450 applies more heat to the liquid jet 52 when liquid jet trajectory 495 is desired. When both actuators 450 and 450*a* are actuated, actuators 450, 450*a* apply equal amounts of heat to the liquid jet 52 when liquid jet trajectory 490 is desired. Because the accuracy of placement of catcher 480 relative to nozzle 420 is precise, the angle of deflection between non-printing trajectory 495 and printing trajectory 490 can be small because the deflection of drops 460, 465 need not accommodate large variations in placement of catcher 480 relative to nozzle 420.

As shown in FIG. 4, catcher 480 includes material layer 410*a*, which is a portion of the same material layer 410 that is included in nozzle 420. The "knife-edge" is also included in material layer 410*a*. Nozzle 420 also includes a material layer 411 which includes actuator 450. The inclusion of material layer 411 contributes the offset configuration of the top surface of catcher 480 and the bottom edge of the exit of nozzle 420. This is because material layer 411 that is included in nozzle 420 is typically removed from the top surface of the catcher 480 during printhead fabrication.

Figure 5:
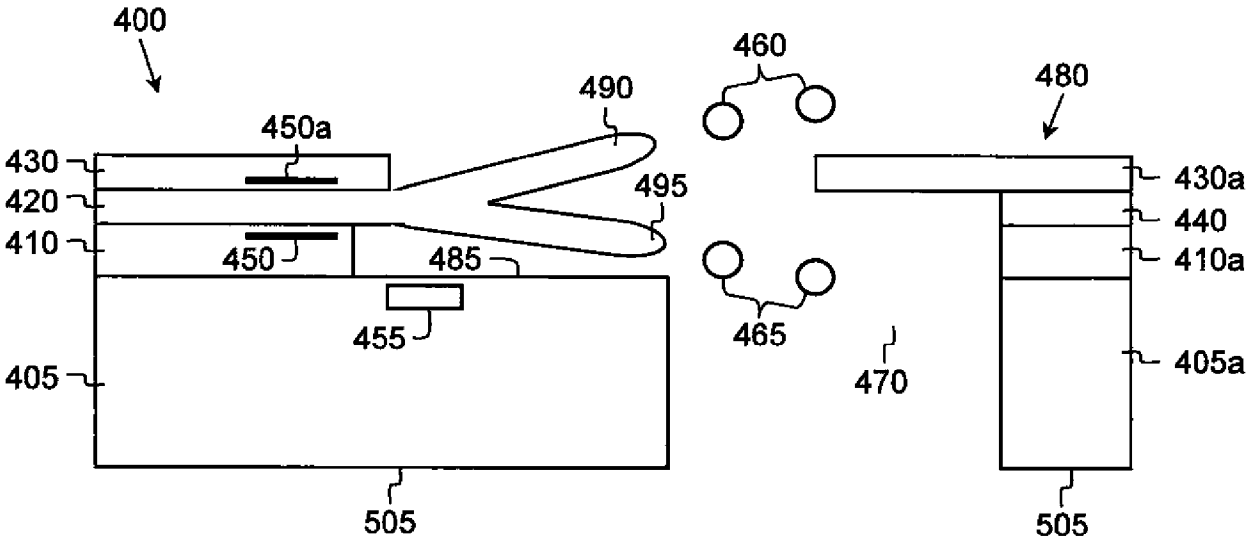
FIG. 5 is a schematic cross sectional view of another example embodiment of a printhead made in accordance with the present invention.
Figure 6:
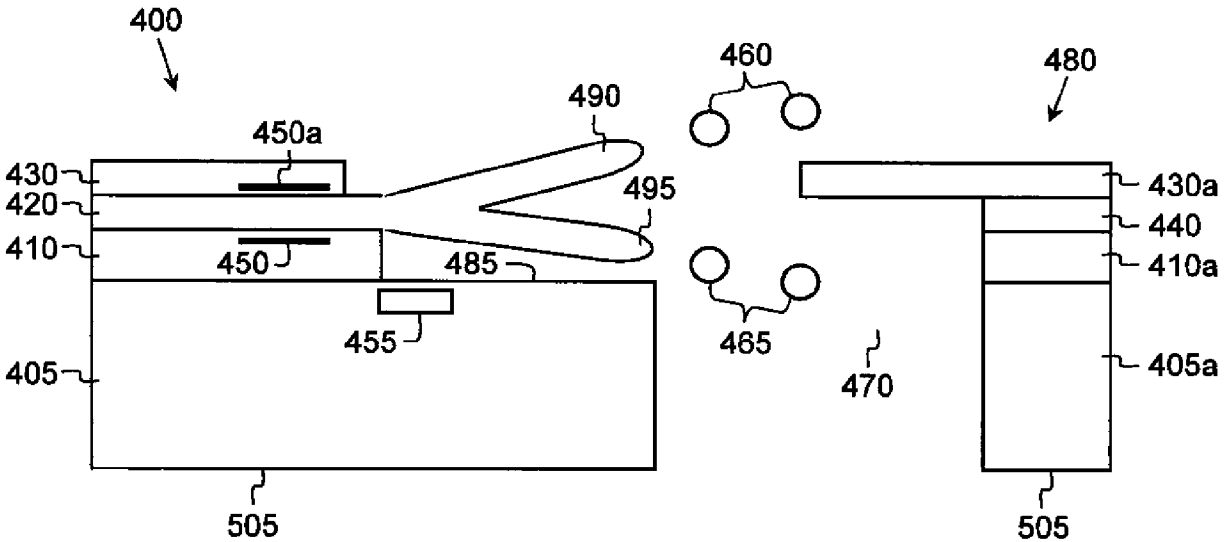
FIG. 6 is a schematic cross sectional view of another example embodiment of a printhead made in accordance with the present invention.
Figure 7:
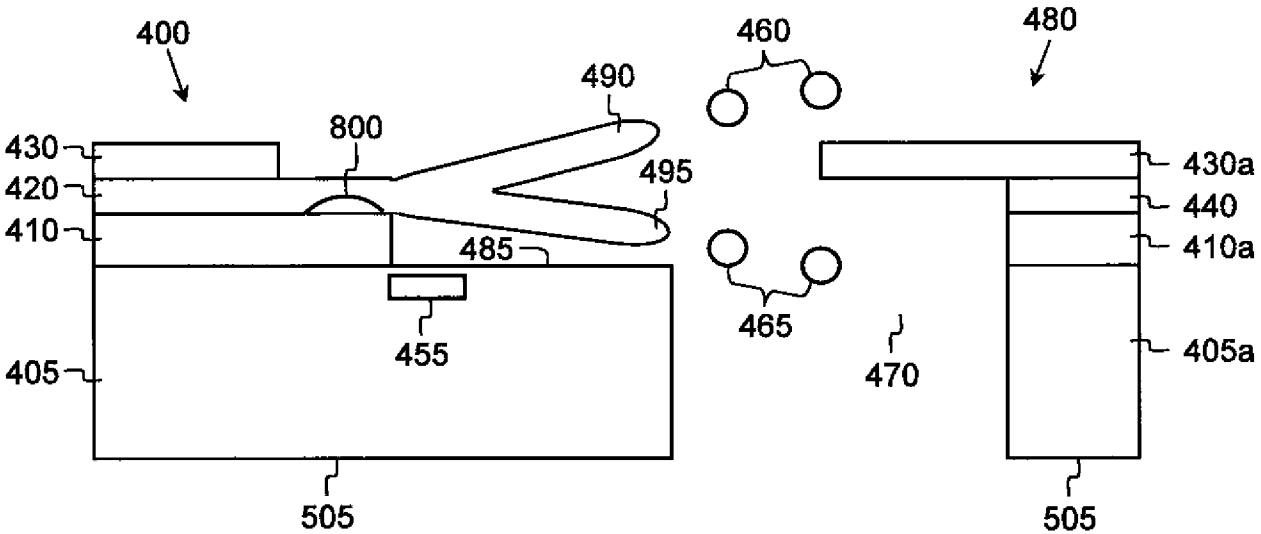
FIG. 7 is a schematic cross sectional view of another example embodiment of a printhead made in accordance with the present invention.

Referring to FIGS. 5-7, additional example embodiments of the present invention are shown. Generally described, one of the plurality of layers, for example, material layer 410 or material layer 430, of nozzle 420 is longer than another of the plurality of layers, for example, material layer 430 or material layer 410, respectively, of nozzle 420 in the direction that the liquid jet 52 is ejected in order to bias the liquid jet 52 toward one of the first path and the second path, for example, trajectory 490 or trajectory 495. Biasing of the liquid jet 52 toward one of a print direction or a non-print (catch) direction as the liquid jet 52 exits nozzle helps to increase the overall deflection angle of the liquid jet 52 in some applications of the present invention.

In FIG. 5, an "over-bite" configuration is shown in which liquid jet trajectories 490 and 495 are biased from the center axis of the nozzle 420 when the actuators are off depending on the amount of "over-bite". This configuration is advantaged in that liquid jet trajectory 490 associated with printing drops 460 can be achieved without action of actuators 450, 450*a*. Liquid jet trajectory 495 is achieved as a result of action of at least actuator 450, for example, the actuation of only actuator 450 or the asymmetric application of heat through the actuation of both actuators 450, 450*a* as described above. Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1).

The "over-bite" configuration can be achieved by laminating and patterning a dry film material to form the material layer 430, 430*a* over the cavity in material layer 410 (nozzle 420). Alternatively, the "over-bite" configuration can be achieved by removing a sacrificial material filled in the cavity in material layer 410 (nozzle 420) between substrate 405, 405*a* and material layer 430, 430*a*.

In FIG. 6, an "under-bite" configuration is shown in which the liquid jet trajectories 490 and 495 are biased from the center axis of the nozzle 420 when the actuators are off depending on the amount of "under-bite". This configuration is advantaged in that liquid jet trajectory 495 associated with the non-printing drops 465 can be achieved without action (inaction) of actuators 450, 450*a*. Liquid jet trajectory 490 is achieved as a result of action of at least actuator 450*a*, for example, the actuation of only actuator 450*a* or the asymmetric application of heat through the actuation of both actuators 450, 450*a* as described above. Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1).

The "under-bite" configuration can be achieved by laminating and patterning a dry film material to form material layer 430, 430*a* over the cavity in material layer 410 (nozzle 420). Alternatively, the "under-bite" configuration can be achieved by removing a sacrificial material filled in the cavity in material layer 410 (nozzle 420) between substrate 405, 405*a* and material layer 430, 430*a*.

In FIG. 7, printhead 30 includes an actuator 800 positioned outside and downstream from the exit of nozzle 420 on material layer 410. This placement location of actuator 800 helps increase the angle of deflection between liquid jet trajectory 490 and liquid jet trajectory 495. Actuator 800 can be a thermal actuator or another of the actuators previously described. Testing has shown that actuation of thermal actuator 800 causes the liquid jet 52 to be deflected away from the thermal actuator 800. This deflection is in the same direction as the deflection of the liquid jet 52 created by actuation of actuator 450*a* when actuator 450*a* is a thermal actuator. Actuator 800 can work in conjunction with actuator 450*a* to achieve larger liquid jet deflection angles. Alternatively, when actuator 800 is located on material layer 430, actuation of thermal actuator 800 occurs in the same direction as the deflection of the liquid jet 52 created by actuation of actuator 450 when actuator 450 is a thermal actuator. Actuator 800 can work in conjunction with actuator 450 to achieve larger liquid jet deflection angles. Accordingly, in some example embodiments of the invention, actuator 800 is included in a configuration with one or both of actuators 450, 450*a* to achieve, for example, larger deflection angles.

Figure 8:
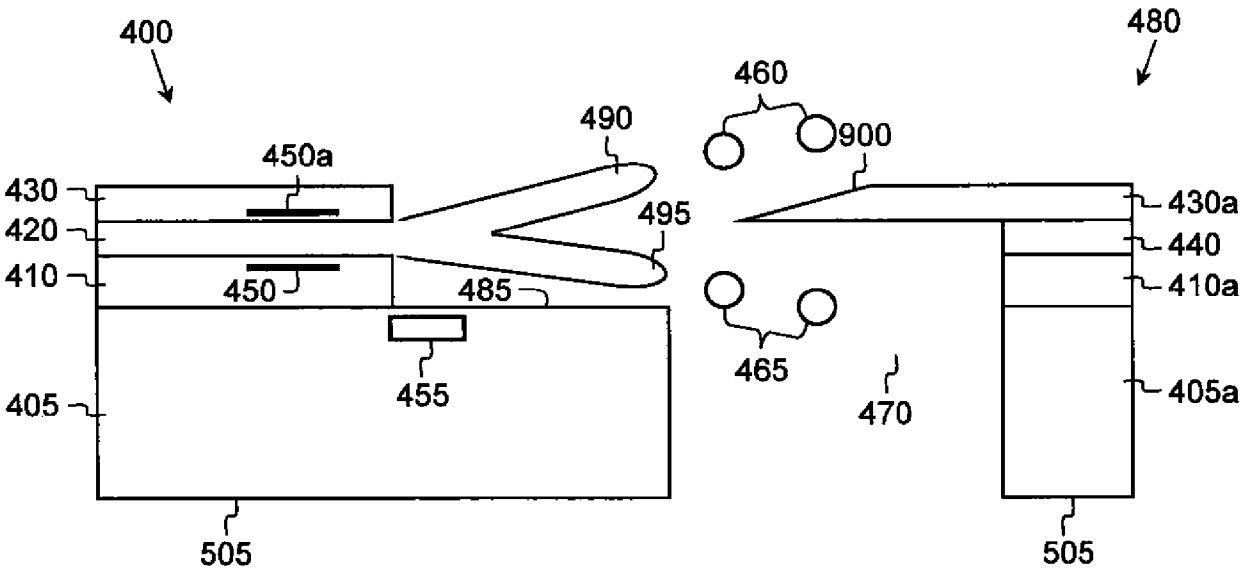
FIG. 8 is a schematic cross sectional view of another example embodiment of a printhead made in accordance with the present invention.
Figure 9:
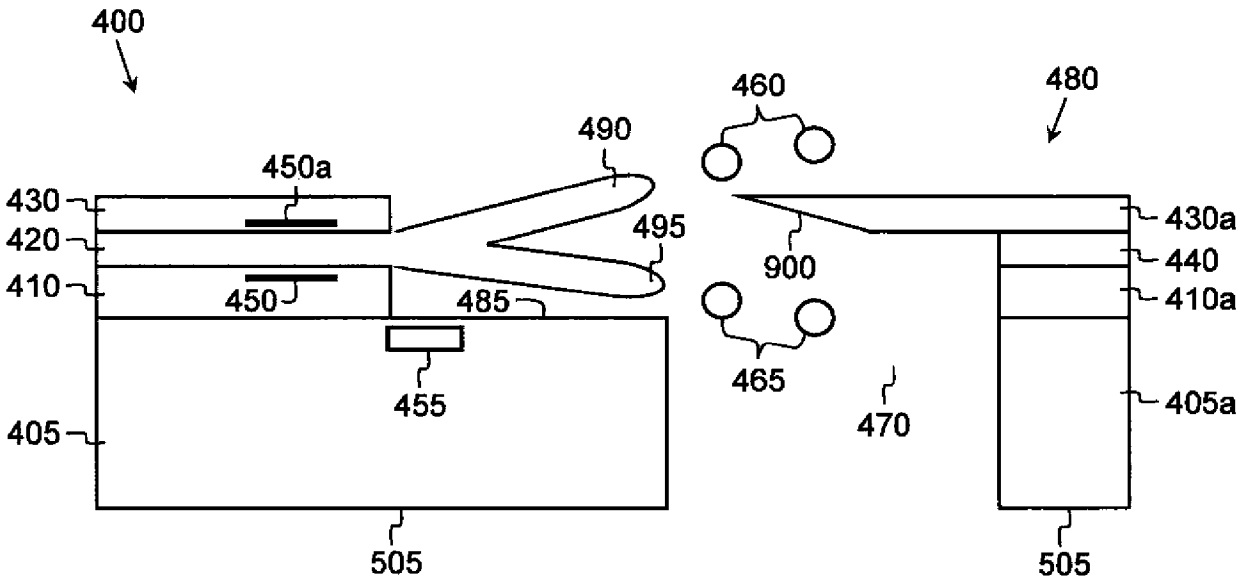
FIG. 9 is a schematic cross sectional view of another example embodiment of a printhead made in accordance with the present invention.

Referring to FIGS. 8 and 9, additional example embodiments of the present invention are shown. In FIGS. 8 and 9, catcher 480 includes a beveled edge 900. Beveled edge 900 provides a sharper "knife-edge" for catcher 480. Because the potential area of intersection for catcher 480 and printing trajectory 490 is smaller when compared to the one shown in FIG. 4, the angle of deflection for printing trajectory 490 can be reduced when compared to the angle of deflection for printing trajectory 490 shown in FIG. 4. Beveled edge 900 is formed by using a defocused exposure in the photolithography patterning process if the material layer 430*a* is a photoimageable polymer. Alternatively, the shape of the beveled edge 900 can be formed by using a defocused exposure in the photolithography patterning process in a photo-imageable mask pattern material layer followed by an etching process to transfer the mask pattern to the catcher material layer 430*a* by removing mask pattern material layer and some of the catcher material layer 430*a*. When this is done, it is preferable that the pattern transfer etching process is an anisotropic plasma dry etch process which maintains the profile of the mask pattern as the mask pattern is transferred to the catcher material layer 430*a*.

Figure 10:
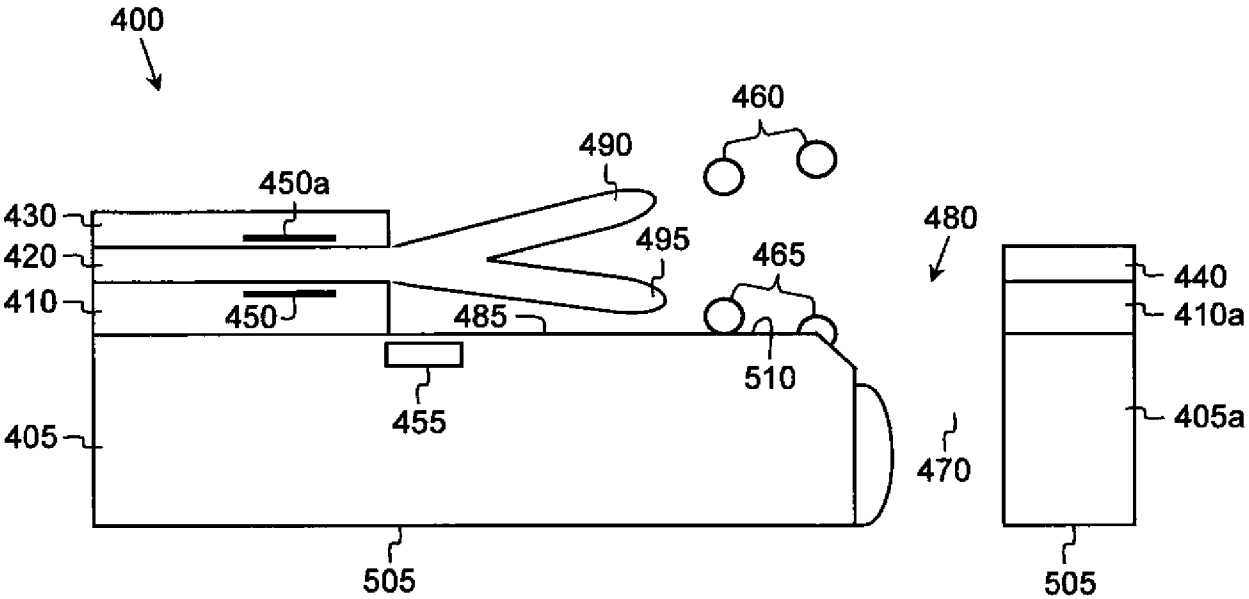
FIG. 10 is a schematic cross sectional view of another example embodiment of a printhead made in accordance with the present invention.

Referring to FIG. 10, another example embodiment of the present invention is shown. Generally described, a printhead made in accordance with this example embodiment of the present invention includes a substrate, a monolithic liquid jetting structure and a catcher. The substrate includes a first surface. The monolithic liquid jetting structure includes a nozzle and a deflection mechanism. A liquid jet is ejected through the nozzle in a direction substantially parallel to the first surface of the substrate. The nozzle includes a plurality of material layers formed on the first surface of the substrate. At least one of the plurality of material layers of the nozzle includes a drop forming mechanism actuated to form liquid drops from the liquid jet. The deflection mechanism is associated with the liquid jet and deflects portions of the liquid jet between a first path and a second path after the portion of the liquid jet exits the nozzle. The liquid drops formed from those portions of the liquid jet following the first path continue to follow the first path. The liquid drops formed from those portions of the liquid jet following the second path continue to follow the second path. The catcher collects liquid drops following the second path and includes a liquid drop contact surface that includes a portion of the first surface of the substrate.

Typically, the printhead includes a plurality of nozzles, for example, arranged in an array, on a common substrate. Liquid, for example, ink, is emitted under pressure through the plurality of nozzles to form filaments of liquid, commonly referred to as liquid jets. In FIG. 10, the plurality of nozzles extends into and out of the figures. The printhead is typically formed from a semiconductor material (for example, silicon) using known semiconductor fabrication techniques (for example, CMOS circuit fabrication techniques, micro-electro mechanical structure (MEMS) fabrication techniques, or a combination of both). For example, the plurality of nozzles is integrally formed through a series of material layering and processing steps, on a common substrate using the fabrication techniques described above to create a monolithic printhead structure. When compared to other types of printheads, monolithic printhead configurations help to improve the alignment of printhead components relative to each other which improves drop deposition accuracy. Monolithic printhead configurations also help to reduce spacing in between adjacent nozzles which helps increase the dots per inch (dpi) capability of the device.

Referring to FIG. 10, a cross-sectional view of printhead 30 including an example embodiment of the present invention is shown. One skilled in the art will recognize this as a cross sectional view of a nozzle and catcher configuration formed using MEMS manufacturing methods well known in the art. In this embodiment, the monolithic liquid jetting structure 400 is formed on a silicon substrate 405. A TEOS (Tetraethyl orthosilicate) layer 410 is deposited on silicon substrate 405. Nozzle 420 is formed by TEOS layer 410 and TEOS layer 430. The spacing between layers 410 and 430 that provides at least the height dimension of nozzle 420 is provided by a polyimide layer 440. In practice, nozzle 420 can be formed using many methods known in the art, including, for example, using a sacrificial layer (not shown), coating TEOS layer 430 over this sacrificial layer, and then removing the sacrificial layer. In FIG. 10, an actuator 450 is shown residing in TEOS layer 410 and an actuator 450*a* is shown residing in TEOS layer 430. Actuators 450 and 450*a* can be thermal (heater), piezoelectric, electrostatic, bimorph metal micro actuator, or other MEMS actuators formed in layers 410 and 430 using conventional MEMS fabrication techniques. Ink or other liquids are supplied to nozzle 420 through a liquid supply channel 475 (shown in FIG. 2).

In the cross sectional view provided by FIG. 2, the extension of these previously described layers is also shown. In this view, silicon substrate 405 is separated from silicon substrate 405*a* by a liquid return channel 470. Channel 470 is created, for example, by drilling or etching silicon substrate 405. Silicon substrate 405 and 405*a* are portions of the same piece of silicon, but are shown separately since they are not connected in this cross sectional view. TEOS layer 410 and 410*a* are similarly connected, as is polyimide layer 440 and 440*a*.

Liquid return channel 470 is located between the first surface 485 of substrate 405, the surface on which monolithic liquid jetting structure 400 is positioned, and a second surface 505 of substrate 405. Liquid return channel 470 is in fluid communication with a catcher 480 and is provided to remove drops 465 that are not used for printing and facilitate liquid transfer to recycling unit 44. Drops 465 are caught by catcher 480 and can be encouraged to retreat from catcher 480 and flow into liquid return channel 470 using a vacuum or other liquid suction devices or liquid removal mechanisms.

A liquid supply channel 475 is located between the first surface 485 of substrate 405, the surface on which monolithic liquid jetting structure 400 is positioned, and a second surface 505 of substrate 405. Liquid supply channel 475 is in fluid communication with nozzle 420 and is provided to supply liquid, for example, ink, to nozzle 420 from liquid channel 47. In one example embodiment, both the ink return channel 470 and the ink supply channel 475 are formed by an anisotropic deep silicon etching process (DRIE) from the surface (a second surface 505) of the substrate 405 opposite to the surface (the first surface 485) of the substrate 405 where the nozzle and catcher is located.

Catcher 480 is formed in this example embodiment by layers 405*a*, 410*a*, 440*a*, and 430*a*. Catcher 480 includes a drop contact surface 510 which includes a portion of first surface 485 of substrate 405, the surface 485 of substrate 405 on which monolithic liquid jetting structure 400 is positioned. Drop contact surface 510 is located downstream from the exit of nozzle 420. Drop contact surface 510 of catcher 480 and nozzle 420 of monolithic liquid jetting structure 400 are offset relative to each other.

Catcher 480 is precisely positioned with respect to nozzle 420. This precision is accomplished by the nature of the MEMS fabrication process, and can be expected to vary less than a micron. Accordingly, the printhead 30 of the present invention is advantaged when compared to conventional continuous printheads in that the catcher 480 is accurately aligned relative to the nozzle 420 of the monolithic liquid jetting structure of the present invention. The precise alignment of catcher 480 and nozzle 420 helps maintain print quality by helping to ensure that sufficient separation between print drops and non-print drops is created during the liquid jet deflection and subsequent drop formation process. Accordingly, the present invention takes advantage of the amount of deflection (the deflection angle) created by the deflection mechanism of the printhead. The invention provides accuracy of placement of catcher 480 relative to nozzle 420, so that deflection of drops need not accommodate variation in the placement of the catcher, and the integrated construction of both nozzle 420 and catcher 480 removes the need for a difficult, expensive and time consuming step of alignment.

During operation of printhead 30, liquid, for example, ink, is continuously emitted under pressure through nozzle 420 to form a filament of liquid 52, commonly referred to as a liquid jet. Drop forming mechanism 28, commonly referred to as a drop forming device, is operable to form liquid drops having a size or volume from the liquid jet 52 ejected through each nozzle 420. To accomplish this, drop forming mechanism 28 includes a drop stimulation actuator(s) 450, 450*a*, for example, a heater or a piezoelectric actuator, that, when selectively activated, perturbs each liquid jet or filament of liquid 52 to induce portions of each jet (or filament) to breakoff from the jet (or filament) and coalesce to form drops 460 and 465.

In FIG. 10, drop stimulation actuator(s) 450, 450*a* includes a heater positioned relative to nozzle 420, for example, located on one or both sides of nozzle 420 or included on or in material layer(s) 410, 430. In alternative example embodiments of the present invention, drop stimulation actuator(s) 450, 450*a* can include a piezoelectric actuator or an electrohydrodynamic stimulator positioned relative to nozzle 420, for example, located on one or both sides of nozzle 420 or included on or in material layer(s) 410, 430. Drop formation using any of these actuators is well known in the art. Typically, one drop forming device 28 is associated with one nozzle 420 of the plurality of nozzles. However, one drop forming device 28 can be associated with groups of nozzles 420 or all of the nozzles 420 of the plurality of nozzles 420.

When drop stimulation actuator 450, 450*a* include heaters deflection of the liquid jet 52 is also accomplished when heat from the heaters is applied asymmetrically to the liquid jet 52 (or filament of liquid). For example, the heater can be a segmented heater with the segments being independently actuatable relative to each other with one segment being positioned in material layer 410 while another segment is positioned in material layer 430. When used in this configuration, the heaters, common referred to as asymmetric heaters, operate as the drop forming mechanism and the deflection mechanism. This type of drop formation and drop deflection is known having been described in, for example, U.S. Pat. No. 6,079,821, issued to Chwalek et al., on Jun. 27, 2000. Accordingly, in some example embodiments of the invention, the drop forming mechanism and the deflection mechanism are the same mechanism, for example, a heater.

Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1). As shown in FIG. 2, liquid jet trajectory 490 is the result of action of at least actuator 450*a* and trajectory 495 is the result of action of at least actuator 450. When both actuators 450 and 450*a* are actuated, one of actuators 450, 450*a* applies more heat to the liquid jet 52 depending on which liquid jet trajectory 495, 490, respectively, is desired. Because the accuracy of placement of catcher 480 relative to nozzle 420 is precise, the angle of deflection between non-printing trajectory 495 and printing trajectory 490 can be small because the deflection of drops 460, 465 need not accommodate large variations in placement of catcher 480 relative to nozzle 420.

In this configuration of the invention, the deflection mechanism is included (along with the drop forming mechanism) in at least one of the plurality of material layers, for example, one or both of materials layers 410, 430 that form nozzle 420. As such, the deflection mechanism and the drop forming mechanism are located upstream from an exit of nozzle 420 (beyond which a portion of the jet is exposed to atmosphere) relative to the direction of jet ejection.

In one example embodiment of this configuration, actuators 450, 450*a* are thermal actuators. As such, as shown in FIG. 10, the deflection mechanism and the drop forming mechanism include a length dimension that is greater than a height dimension with the length dimension being parallel to the direction of liquid jet 52 ejection through nozzle 420 which helps to add heat to the liquid jet 52 as the liquid jet 52 passes by the actuators ultimately helping to increase the angle of deflection of the liquid jet 52. As the thermal actuators are positioned parallel to the liquid channel included in nozzle channel 420, the actuators provide a large area for heat transfer to the liquid traveling through the fluid channel formed in nozzle 420. This thermal actuator configuration is advantaged in that it helps provide improved heat transfer or large deflection angles.

When drop stimulation actuator 450, 450*a* is a symmetric heater or a piezoelectric actuator or an electrohydrodynamic stimulator deflection can be accomplished using a conventional electrostatic deflection mechanism. Typically, the electrostatic deflection mechanism incorporates drop charging and drop deflection in a single electrode, as described in U.S. Pat. No. 4,636,808, or includes separate drop charging and drop deflection electrodes as is known in the art. When printhead 30 includes an electrostatic deflection mechanism, the electrode(s) 455 of the electrostatic deflection mechanism is positioned proximate to the liquid jet 52, for example, on the first surface 485 of substrate 405. Electrode(s) 455 is located upstream relative to drop contact surface 510 of catcher 480. Typically, the location of electrode(s) 455 of the electrostatic deflection mechanism is outside of nozzle 420 and downstream of nozzle 420 relative to the direction of travel of the liquid jet 52. The electrostatic deflection mechanism including the electrode(s) are formed using conventional MEMS or CMOS fabrication techniques.

Printing trajectory 490 is intended for drops 460 that ultimately are printed and contact the print media (shown in FIG. 1), and non-printing trajectory 495 is intended for drops 465 that ultimately are not printed and do not contact the print media (shown in FIG. 1). As shown in FIG. 10, liquid jet trajectory 490 and trajectory 495 is the result of action of the electrostatic deflection mechanism. Because the accuracy of placement of catcher 480 relative to nozzle 420 is precise, the angle of deflection between non-printing trajectory 495 and printing trajectory 490 can be small because the deflection of drops 460, 465 need not accommodate large variations in placement of catcher 480 relative to nozzle 420. Alternatively, liquid jet trajectory 490 can be the result of inaction of the electrostatic deflection mechanism as described with reference to FIG. 4. In this configuration, material layer 440 is typically not present on substrate 405*a*.

The drop forming mechanism is included in at least one of the plurality of material layers, for example, one or both of materials layers 410, 430 that form nozzle 420. As such, the drop forming mechanism is located upstream from an exit of nozzle 420 (beyond which a portion of the jet is exposed to atmosphere) relative to the direction of jet ejection. The deflection mechanism is located downstream from the nozzle exit (beyond which a portion of the jet is exposed to atmosphere) relative to the direction of jet ejection. Additionally, the drop forming mechanism includes a length dimension that is greater than a height dimension with the length dimension being parallel to the direction of liquid jet 52 ejection through nozzle 420 which helps to add heat to the liquid jet 52 as the liquid jet 52 passes by the actuators ultimately helping to create a consistent drop break-off location relative to the electrode(s) 455 for the liquid jet 52.

As shown in FIG. 10, catcher 480 is a Coanda type catcher. Another example embodiment of this invention configuration contemplates a porous face catcher. The porous catcher face itself is conventional and known in the art.

The example embodiments described above with reference to FIGS. 3-7 can be implemented in combination with the example embodiment described with reference to FIG. 10. Accordingly, a printhead made in accordance with the present invention that includes a drop contact surface 510 can also include one or a combination of the features described above with reference to FIGS. 3-7. For example, one of the plurality of layers of nozzle 420 can be longer than another of the plurality of layers of nozzle 420 in the direction that the liquid jet is ejected so as to bias the liquid jet toward one of the first path and the second path. The first surface 485 of substrate 405 can be recessed at a location downstream of the nozzle exit, beyond which a portion of the jet is exposed to atmosphere, relative to the direction of jet ejection.

The invention has been described in detail with particular reference to certain preferred embodiments thereof, but it will be understood that variations and modifications can be effected within the scope of the invention.

Parts List

| | |
|---|---|
| 20 | continuous printer system |
| 22 | image source |
| 24 | image processing unit |
| 26 | mechanism control circuits |
| 28 | device |
| 30 | printhead |
| 32 | recording medium |
| 34 | recording medium transport system |
| 36 | recording medium transport control system |
| 38 | micro-controller |
| 40 | reservoir |
| 42 | catcher |
| 44 | recycling unit |
| 46 | pressure regulator |
| 47 | channel |
| 52 | liquid jet, filament of liquid |
| 400 | liquid jetting structure |
| 405 | silicon substrate |
| 405a | silicon substrate |
| 410 | material layer |
| 410a | material layer |
| 411 | material layer |
| 420 | nozzle |
| 430 | material layer |
| 430a | material layer |
| 440 | material layer |
| 440a | material layer |
| 450 | actuator |
| 450a | actuator |
| 455 | electrode(s) |
| 460 | liquid drops |
| 465 | liquid drops |
| 470 | liquid return channel |
| 475 | liquid supply channel |
| 480 | catcher |
| 485 | first surface |
| 490 | printing trajectory |
| 495 | non-printing trajectory |
| 500 | gap |
| 505 | second surface |
| 510 | drop contact surface |
| 800 | actuator |
| 900 | beveled edge |

The invention claimed is:

1. A printhead comprising:

a substrate including a first surface; and a monolithic liquid jetting structure including:

a nozzle through which a liquid jet is ejected in a direction substantially parallel to the first surface of the substrate, the nozzle including a plurality of material layers formed on the first surface of the substrate, at least one of the plurality of material layers of the nozzle including a drop forming mechanism actuated to form liquid drops from the liquid jet;

a deflection mechanism associated with the liquid jet that deflects portions of the liquid jet between a first path and a second path after the portion of the liquid jet exits the nozzle, the liquid drops formed from those portions of the liquid jet following the first path continuing to follow the first path, the liquid drops formed from those portions of the liquid jet following the second path continuing to follow the second path; and a catcher that collects liquid drops following the second path, the catcher including a material layer formed on the first surface of the substrate.

2. The printhead of claim 1, wherein a portion of the catcher and a portion of the nozzle of the monolithic structure share a common material layer.

3. The printhead of claim 2, wherein the common material layer is located on a side of the liquid jet that is opposite the first surface of the substrate.

4. The printhead of claim 1, the catcher including a drop contact surface, wherein the drop contact surface of the catcher and the nozzle of the monolithic structure are offset relative to each other.

5. The printhead of claim 1, wherein the drop forming mechanism and the deflection mechanism are the same mechanism.

6. The printhead of claim 5, wherein the mechanism is a heater.

7. The printhead of claim 1, wherein the deflection mechanism is included in at least one of the plurality of material layers that form the nozzle.

8. The printhead of claim 7, wherein the deflection mechanism and the drop forming mechanism includes a length dimension that is greater than a height dimension, the length dimension being parallel to the direction of jet ejection.

9. The printhead of claim 7, the nozzle including an exit beyond which a portion of the jet is exposed to atmosphere, wherein the deflection mechanism is located upstream from the nozzle exit relative to the direction of jet ejection.

10. The printhead of claim 7, the nozzle including an exit beyond which a portion of the jet is exposed to atmosphere, wherein the deflection mechanism is located downstream from the nozzle exit relative to the direction of jet ejection.

11. The printhead of claim 1, the substrate including a second surface, the printhead further comprising:

a channel located between the first surface of the substrate and the second surface of the substrate, the channel being in fluid communication with the catcher.

12. The printhead of claim 1 the nozzle including an exit beyond which a portion of the jet is exposed to atmosphere, wherein the first surface of the substrate is recessed at a location downstream of the nozzle exit relative to the direction of jet ejection.

13. The printhead of claim 1, wherein an outermost material layer of the nozzle is farther away from the substrate than the outermost material layer of the catcher.

14. The printhead of claim 1, wherein one of the plurality of material layers of the nozzle is longer than another of the plurality of layers of the nozzle in the direction that the liquid jet is ejected.

15. The printhead of claim 1, the substrate including a second surface, the printhead further comprising:

a channel located between the first surface of the substrate and the second surface of the substrate, the channel being in fluid communication with the nozzle.

* * * * *